US005249706A

United States Patent [19]

Szabo

[11] Patent Number: 5,249,706

[45] Date of Patent: Oct. 5, 1993

[54] REFRIGERATED LIQUID DISPENSER HAVING A SHUT-OFF VALVE

[76] Inventor: John Szabo, 556 Edge Lane, Pickering, Ontario, Canada, L1W 3A1

[21] Appl. No.: 562,665

[22] Filed: Aug. 3, 1990

Related U.S. Application Data

[63] Continuation-in-part of Ser. No. 247,624, Sep. 22, 1988, abandoned.

[51] Int. Cl.[5] ..... B67D 5/08; B67D 5/62; B65D 37/00

[52] U.S. Cl. ..... 222/20; 222/54; 222/63; 222/146.6; 222/212; 165/80.3; 251/7

[58] Field of Search ..... 222/14, 16, 20, 54, 222/63, 146.6, 212, 214, 215, 209; 165/80.3, 76, 185; 417/412, 413; 251/4–10

[56] References Cited

U.S. PATENT DOCUMENTS

| | | | |
|---|---|---|---|
| 2,957,607 | 10/1960 | Smith | 281/6 X |
| 3,152,728 | 10/1964 | McCarter | 222/146.6 X |
| 3,216,496 | 11/1965 | Katz | 165/80.3 |
| 3,248,011 | 4/1966 | Brodsky et al. | 251/7 |
| 3,502,095 | 3/1970 | Grenzberg et al. | 251/6 X |
| 3,511,468 | 5/1970 | Young | 251/6 |
| 3,543,791 | 12/1970 | Fox | 251/7 X |
| 3,743,140 | 7/1973 | Sauerbrey | 222/63 |
| 4,055,279 | 10/1977 | Lapera et al. | 222/54 |
| 4,135,647 | 1/1979 | Mascia et al. | 222/214 X |
| 4,331,262 | 5/1982 | Snyder et al. | 222/63 X |
| 4,484,599 | 11/1984 | Hanover et al. | 251/6 X |
| 4,804,118 | 2/1989 | Mullen et al. | 222/146.6 X |
| 4,856,755 | 8/1989 | Clarke | 251/6 |

FOREIGN PATENT DOCUMENTS

| | | | |
|---|---|---|---|
| 1225972 | 8/1987 | Canada | 222/146.6 |

OTHER PUBLICATIONS

Enertech R&D Ltd. Brochure.

*Primary Examiner*—Michael S. Huppert
*Assistant Examiner*—Kenneth DeRosa

[57] ABSTRACT

A dispenser for liquids having an insulated cool chamber to receive a liquid container with a flexible tube for flow of liquid, a heat exchanger or pump in the chamber to pump liquid along the tube, a shut-off valve in the chamber below the pump with an opening for the tube to pass to a dispensing point outside the chamber, a motor and shaft for driving the pump, and gears connected between the motor shaft and the pump, a revolution counter coupled to the motor shaft, and connected to a counter logic circuit to count each revolution of the motor shaft, and manual controls mounted on the chamber and connected to the shut-off valve and to the motor, and to the counter logic circuit so that the shut-off valve opens within the chamber and the motor is started thereby driving the pump within the chamber, and automatically stopping the motor shaft when the predetermined count is reached, thereby maximizing the accuracy of the volume of liquid pumped by the pump.

6 Claims, 6 Drawing Sheets

REFRIGERATED LIQUID DISPENSER HAVING A SHUT-OFF VALVE

This application is a continuation-in-part of U.S. application Ser. No. 247,624, filed Sep. 22, 1988, entitled Liquid Dispenser, Inventor John Szabo, now abandoned.

BACKGROUND OF THE INVENTION

FIELD OF THE INVENTION

The invention relates to a dispenser for liquid products, and in particular for dairy products such as milk, cream and the like, which require refrigeration.

Many liquid products are required to be dispensed in small units. Various beverages, such as dairy products, are frequently pre-packaged in small individual unit sized containers. These are, however, relatively expensive to produce. Empty containers create a disposal problem. Typically, cream used for tea and coffee and the like, is packaged and dispensed in this way.

It is, however, well known that such dairy products require to be stored under refrigeration. Consequently, it is necessary to store such liquid containers in a refrigerated cabinet, and then to maintain a small supply at the point where they are actually used. This creates added expense and inconvenience.

Clearly, it is desirable if the liquid products can be packaged in much larger volume containers, stored in a refrigerated cabinet, and dispensed directly from the refrigerated cabinet in unit sized portions as they are required.

In addition to the refrigeration of the liquid material, it is desirable that the liquid shall be dispensed in as far as possible precisely predetermined unit dosages, preferably selected from a range of unit dosages by the actual customer. In addition, it is desirable that such unit dosages shall be capable of being adjusted by the management of the restaurant or facility so as to provide a high degree of control over the consumption of such liquid.

In the past, proposals have been made for the dispensing of liquids such as dairy products from a larger container, typically a flexible plastic bag. Dispensing in one earlier proposal was achieved by means of a peristaltic pump, operating on a flexible plastic tube which was joined integrally with the bag containing the liquid.

This system was desirable since it maintained as far as possible sterility in the handling of the liquid material. However, the control of pumps of this type is a critical factor. As is well known, such pumps operate by means of rotor arms, each of which carry rollers, which roll in contact with a tube. In this way, a liquid within the tube between any two rollers is forced around an arcuate path in a peristaltic pumping action. Controlling of pumps of this type however present certain problems. In one proposal, it was suggested that this could be achieved by means of an electrical motor and a timer, operating the motor for a predetermined time limit. However, timers are well known to suffer from variation due, for example, to fluctuations in line voltage, and other factors, causing inaccuracies. As a result, earlier proposals using electrical motors and timers produced dispensing of the liquid in accurate and variable unit dosages. This led to some degree of customer dissatisfaction. In addition, however, and more importantly, it led to a degree of unpredictability in the consumption of such liquid which, in turn, involved problems for management.

One of the particular problems flowing from the use of this type of pump is the fact that the increments of liquid between the rollers of such a pump are relatively large. Consequently, it is not enough simply to make the pump, as it were, stop with a roller in a predetermined position. It is necessary to be able to stop the pump at any rotational position, and then to provide a check valve restraining any further flow of liquid in the flexible tube.

This then requires the use of a check valve in addition to the use of some form of control on the rotation of the pump. There is, therefore, inevitably a certain length of tube between the pump and the check valve. Liquid that may stand within this length of tube, unless it also is refrigerated, will tend to spoil. Thus a customer using such a dispenser after a relatively long period of inactivity, particularly in warmer weather, may receive a serving of the liquid which is in less than fresh condition. For all of these reasons, therefore, this type of equipment must be carefully designed so that the requirements for precise incremental servings can be repeatedly be achieved with a high degree of accuracy and, at the same time, in which all of the liquid both in the bag, and in the tube passing through the pump, and in the portion of the tube extending from the pump to the serving point, is all maintained under refrigerated hygienic conditions.

In addition to all of these factors, it is essential that such equipment must be capable of being maintained in a fully hygienic condition. It thus must be easy to dismantle, clean and reassemble on a daily basis by personnel having no experience whatever, other than that of serving food and beverages in such a facility.

BRIEF SUMMARY OF THE INVENTION

With a view to solving the various problems noted above, the invention provides a dispenser for liquids comprising a storage chamber, insulation means enclosing said chamber, heat exchanger means connected with said chamber, and adapted to transfer heat from within said chamber, said chamber being dimensioned and adapted to receive a liquid container, having a flexible tube connected to a lower portion thereof, for flow of said liquid from said container, pump means in said chamber, and adapted to receive said tube, and operable to pump said liquid along said tube, shut-off valve means within said chamber and below said pump, opening means in said chamber for said tube to pass to a dispensing point outside said chamber, power-operated means for operating said shut-off valve means, motor means for driving said pump means, and gear means connected between said motor means and said pump means by a motor shaft, said gear means being connected to said pump means by a gear shaft, a revolution counter operatively coupled to said motor shaft and said motor shaft being connected to a counter logic circuit, whereby to count each revolution of said motor shaft, and said gear box reducing the speed of revolution between said motor shaft and said gear box shaft, and manual control means mounted on said chamber and connected to said shut-off valve and to said motor means, and to said counter logic circuit, whereby upon operation of said manual control means, said shut-off valve opens within said insulated chamber and said motor is operated for a predetermined number of revolutions of said motor, thereby driving said pump, within said insulated chamber, a predetermined number of revolutions less than the number of revolutions of said motor, and said counter logic, automatically stopping said motor when said predetermined number of motor revolutions is reached.

More particularly, the invention provides such a dispensing apparatus wherein the pump comprises a peristaltic pump, having at least two roller cams, and a movable housing for receiving said pipe. More particularly, the invention provides such a dispensing apparatus and further including a tube mounting bracket, with frictional tube engaging means between said bag and said pump, whereby to prevent said tube being drawn through said pump. More particularly, the invention provides such a liquid dispensing apparatus, wherein said shut-off valve comprises a rotatable boss, and a slot within the boss, which is shaped to receive the tube, the boss being mounted on a shaft, and including power operated means for procuring partial rotation of said shaft. More particularly, the invention provides such a liquid shut-off valve further includes fixed stop members on both sides of said tube, and wherein said boss is rotatably mounted between the two stop members, so that rotation of the boss causes opposite sides of said tube to be squeezed simultaneously, the various components being designed to permit all round access for cleaning.

More particularly, the invention provides a heat exchanger for use in association with a refrigerator cabinet, said exchanger comprising a thermal electric device, responsive to electrical power to cause a temperature differential thereacross, and a heat exchanger plate portion mounted on the hot side of said thermal electric device, said block portion being formed with a plurality of parallel grooves having a tapered cross-section, and including a plurality of heat exchanger fins, each said fin having an edge portion formed with a cross-sectional configuration in the form of a taper matching the taper of said grooves, and wherein the angle of said taper is designed to procure by frictional retention of said tapered edges of said fins in said grooves.

More particularly, the invention provides a liquid dispenser of the general type described, and further including a removable receptacle for receiving said liquid container, said receptacle defining a bottom side and a back wall, and having tube opening means in said bottom wall for passage of said tube therethrough, and have sensing opening means in one of said side walls and said back wall, and temperature sensing means in said cabinet, a probe portion connected to the housing and adapted to enter said sensing opening, whereby to continuously sense the actual temperature of the contents of said bag.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
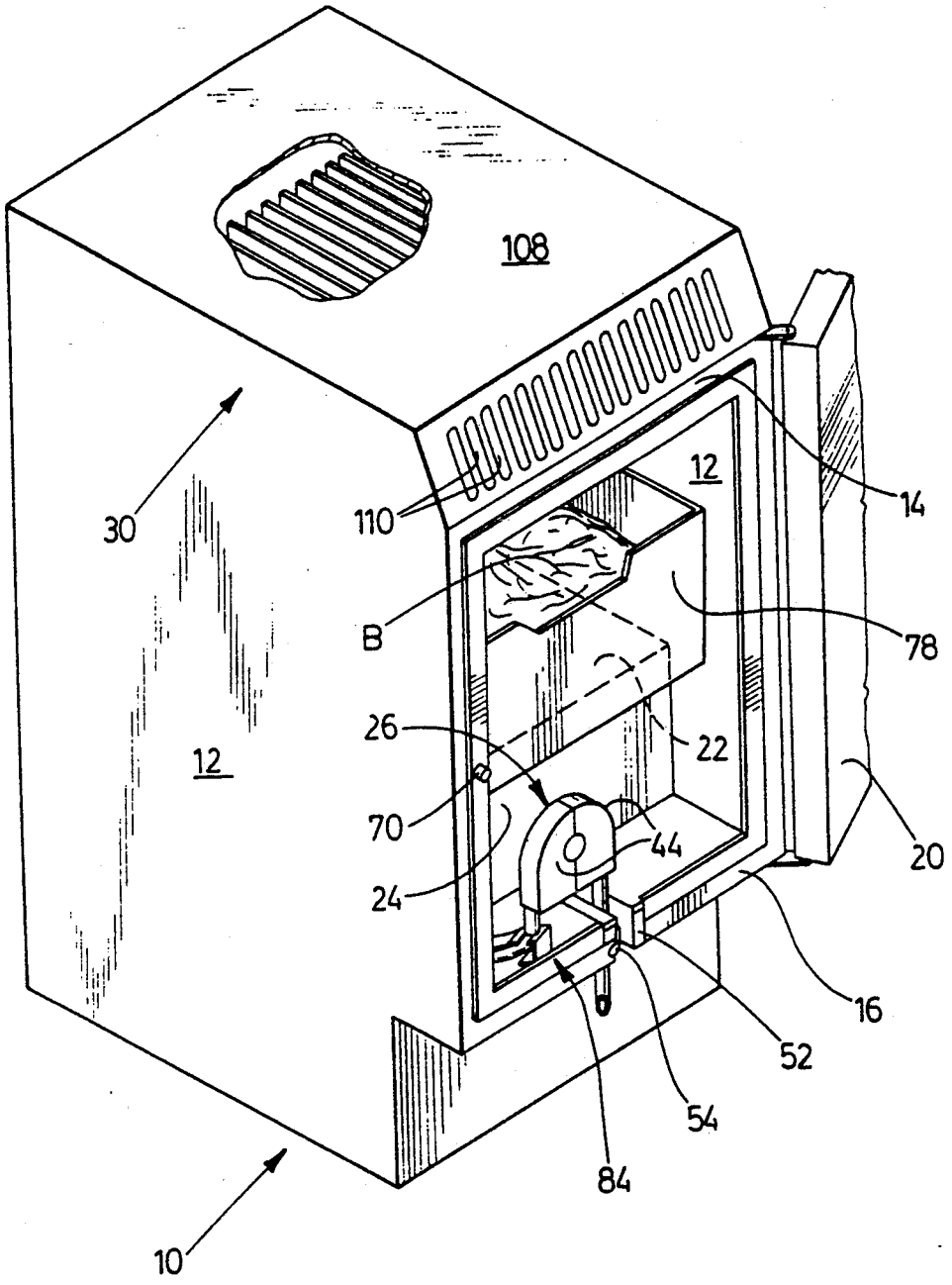
FIG. 1 is a front perspective illustration of a liquid dispenser according to the invention, partially cut-away and showing a bag receptacle partially inserted therein.

Referring now to FIG. 1, the invention will be seen to be illustrated in the form of a cream dispenser, typically for use in self-service restaurants, alongside the beverage station where tea and coffee are dispensed.

The beverage dispenser will typically be operated either by restaurant personnel, or else individually by the actual customers.

The liquid, in this case cream, will typically be contained in flexible plastic bags B, provided with elongated flexible tubes T, by means of which the contents can be dispensed.

It will, of course, be appreciated however that the invention is not limited exclusively to the dispensing of cream, but could equally well be used for dispensing a variety of other liquids or indeed semi-liquid flowable products such as mayonnaise, ketchup, and other products if so desired.

In order to maintain the entire contents of the bag, and the tube, at a reduced temperature to avoid spoilage, the invention comprises as a principal feature a generally rectangular cabinet indicated generally as 10, having side walls 12—12, a top wall 14, and a partial bottom wall 16, and a rear wall 18.

A door 20 is provided on the front of the cabinet.

The side walls, top and rear walls and partial bottom wall and the front door are all insulated.

Within the cabinet, an insulated support wall 22 is located, extending from back wall 18 towards the front of the cabinet, but terminating short of the door 20 and defines, with rear portions of the side walls, a storage compartment.

An insulated partial partition wall 24 meets the forward edge of the support wall 22 and together with forward portions of the side walls, and top wall, define a pump and valve compartment. Support wall 22 and partition 24 are both insulated, and the partial bottom wall 16 is also insulated, to provide a completely enclosed and insulated chamber for the bag B and tube T.

The door 20 is hinged along one side and typically may be secured closed in any suitable manner, for example, by a magnetic gasket or the like, such as is well known in the refrigeration art, which is not shown here for the sake of clarity.

On the other hand, if desired, some form of secure fastening means such as a key lock could be provided (not shown) if vandalism or abuse was a problem.

Within the insulated chamber 10, in the pump and valve compartment defined by the partition wall 24, and the partial bottom wall 16, there is provided a pump 26. Pump 26 is what is known as a peristaltic pump, such as is well known in the pumping art, in particular in relation to the sterile pumping of fluids in medical and hospital practice. Pumps of this kind have a removable housing, and two or more cams or lobes usually in the form of rollers, on radial arms. A tube containing a liquid is placed in the housing, around the cams. Operation of the pump causes the lobes or cams to squeeze, and move around the tube and thus force the liquid along the tube in what is usually described as a peristaltic action.

The details of such pumps, which are available from others, are well known in the art, and require no further description.

Also, within the pump and valve compartment of the insulated chamber and adjacent to the partial bottom wall 16, there is provided a shut-off valve indicated generally as 28. The shut-off valve 28 is located below and to one side of the pump 26, and receives the tube from the pump, and defines the point at which the tube exits the insulated chamber 10.

In FIG. 1, the bag is shown in phantom as B, and the tube is shown in phantom as T.

A dispensing point D is defined by the lower free end of the tube T.

On the top wall 14 of the chamber 10, there is provided a refrigeration unit indicated generally as 30. Refrigeration unit 30 is adapted to extract heat from the interior of chamber 10 and transfer it to the ambiant atmosphere, thus maintaining the interior of the chamber 10 at a reduced temperature, to prevent spoilage of the liquid contained in the bag B and tube T.

Before describing the various components in detail, it will already be appreciated that what the invention now provides is an insulated rifrigerated chamber which entirely contains both the bag B, and the tube T through which the liquid is dispensed, and also the pump 26, with the tube T exiting from the chamber through the shut-off valve 28.

As will be apparent from the following description, once the shut-off valve is closed, and it is always closed while the unit is not in actual use dispensing liquid, then all of the liquid is contained in the refrigerated chamber, and is, therefore, protected against spoilage.

Figure 2:
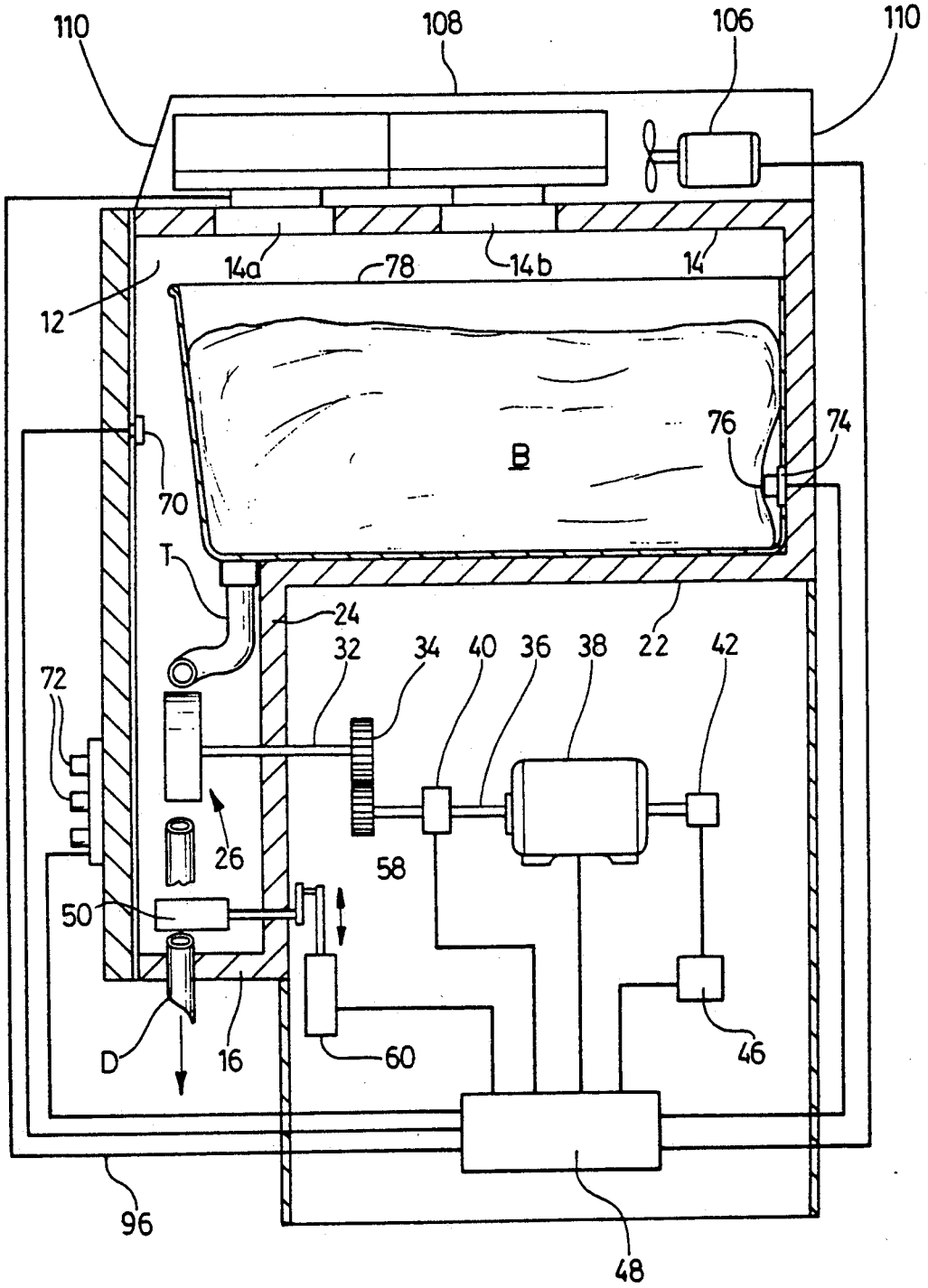
FIG. 2 is a schematic block diagram of the liquid dispenser of FIG. 1.

Referring now to FIG. 2, this illustrates in schematic and block diagrammatic form, a schematic side elevation, partially sectioned, of the liquid dispenser of FIG. 1.

Referring first of all to the pump 26 and its associated mechanism, it will be seen that pump 26 is driven by means of a gear output shaft 32 which, in turn, is driven by gears 34. Gears 34 are, in turn, driven by a motor shaft 36, driven by a motor 38.

The motor 38 is provided with an electrically-operable brake 40, whereby to provide a fast means of halting operation of the motor, for reasons to be described below.

Also operatively coupled directly to the shaft 36 of motor 38 is a revolution counter 42. Revolution counter 42 is adapted to provide a signal pulse for each revolution of the motor 38. Such counters are well known in the art and require no description.

Gears 34 are adapted to provide a substantial reduction in RPM's, typically in the region of between 15 to 1 and 20 to 1 reduction. Thus the shaft 32 will be rotating at only a fraction of the speed of shaft 36.

As noted above, pump 26 has a two-part movable housing indicated generally as 44 (FIG. 1). The movable housing 44 is constructed so that it may be opened up to receive the tube T, and then closed up again.

As noted, the details of such pump and housing are well known to persons skilled in the art, and are consequently omitted for the sake of clarity.

The counter 42 is connected to counter logic circuit 46 which is, in turn, connected to a control panel 48.

Brake 40 is also connected to the control panel 48, as is the motor itself.

Figure 3:
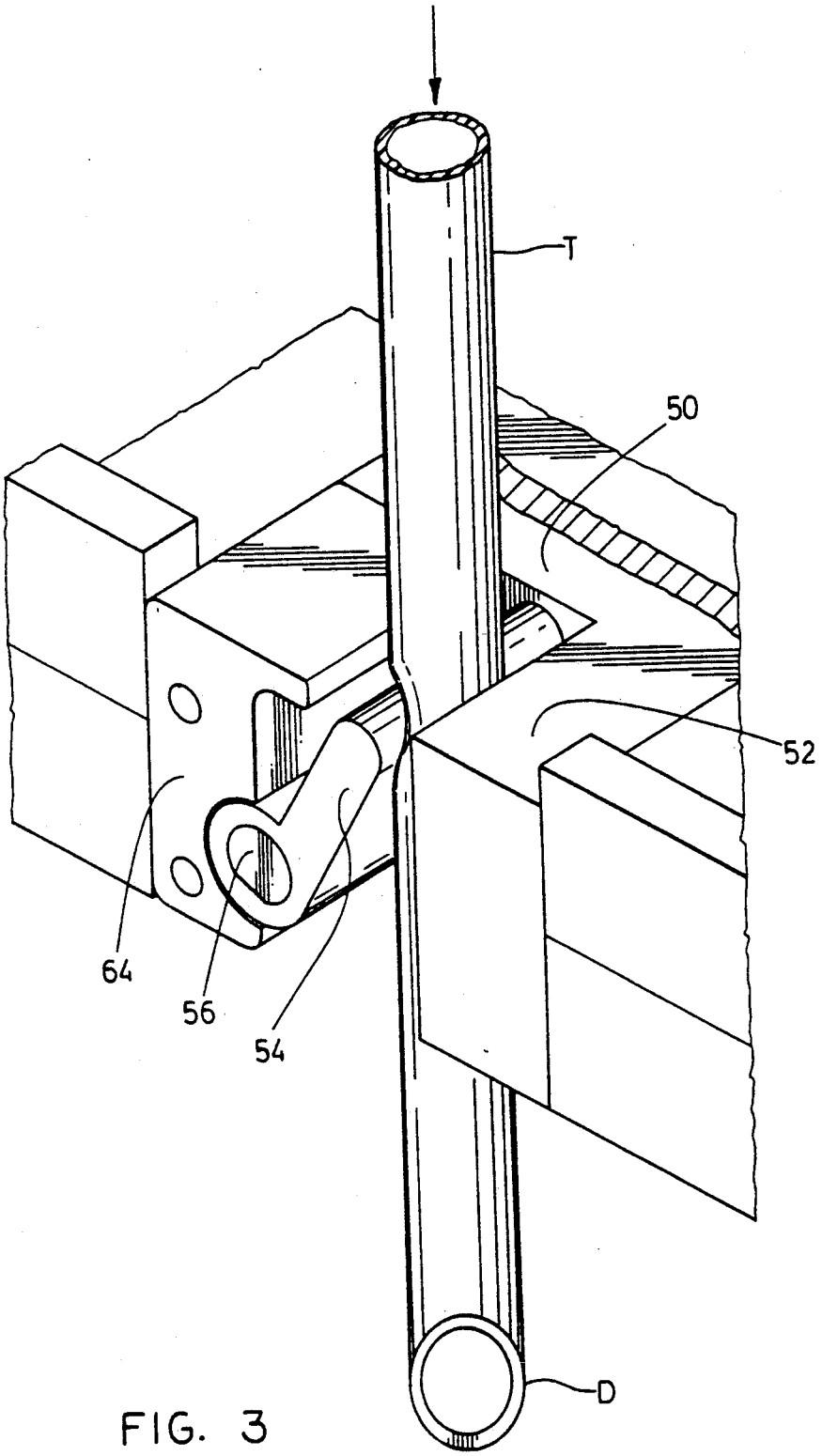
FIG. 3 is an enlarged perspective illustration of the shut-off valve.
Figure 4:
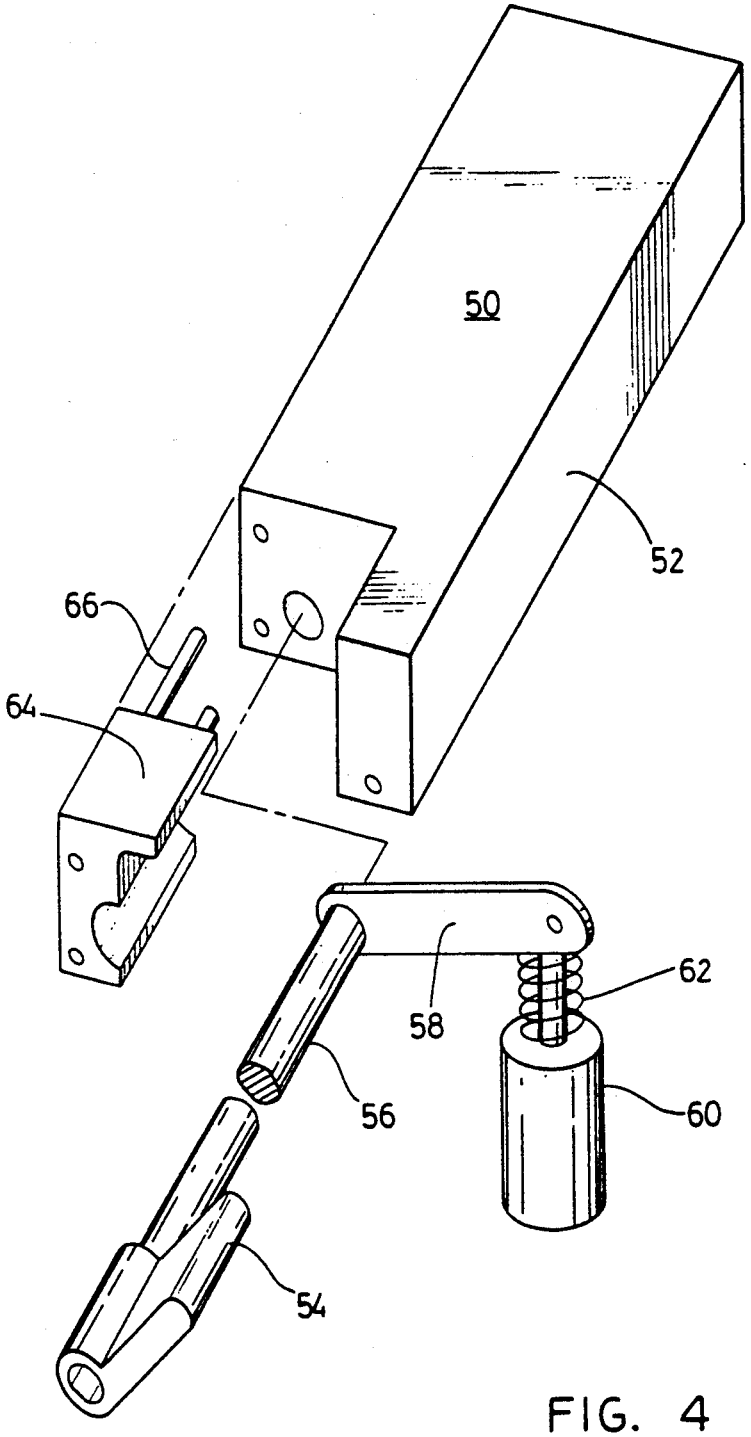
FIG. 4 is an exploded perspective of the shut-off valve.

Referring now to FIGS. 3 and 4, the shut-off valve is shown in more detail. It will be seen to comprise a support body portion 50, having a generally cylindrical axial recess 51, and having upper and lower slotted recesses 52—52 therein. Recesses 52 define shoulders 53 on opposite sides. A rotatable boss 54, of generally cylindrical shape is adapted to be received in recess 51, and is removable therefrom in a manner to be described below.

Boss 54 defines a central axial counter-bore 56, extending inwardly therefrom from its inward end, and a transverse drive notch 58 formed in its rear surface registering with counter-bore 56.

A slotted opening 60 is formed transversely through the front of the boss 54, defining a width dimension equal to the width of the slotted openings 52 in the member 50, and defining a depth substantially the same as the depth of the slotted openings 52.

Boss 54 is adapted to be rotatably received in recess 51 of member 50. A drive shaft 61 is adapted to be received in a drive bore 62 formed in member 50. The leading end of shaft 51 has a drive pin 63 extending transversely thereof. The leading end of shaft 51 is adapted to be received in counter-bore 56, with the drive pin 63 received in the recess 58 of boss 54.

At its rear end, shaft 51 is connected by means of a crankshaft or lever 64, to any suitable power-operated means such as the solenoid 65 and spring 66.

It will thus be seen that operation of the solenoid 65 will procure semi-rotation of the boss 54 in one direction, and relaxing of the solenoid 65 will permit the spring 66 to rotate the boss 54 in the reverse direction. This will then produce the double pinching action on the tube T illustrated in FIG. 3.

This pinching action effectively squeezes the tube T in two places, thereby providing a secure drip-free shut-off of liquid flow.

For cleansing purposes, the tube T can be removed, the boss 60 can simply be withdrawn from the recess 51, and the recess 51 can then be cleaned out, and the boss 54 can be washed and sterilized.

In this way, a fully sanitary form of operation can be maintained for the apparatus at all times.

The machine is powered "on" or "off" by means of a resettable circuit breaker located at the rear.

An override switch (not shown) is connected to the control panel 48. Its function is to cut out the operation of the solenoid 65 so that the boss 54 is returned by the spring to its vertical position. In this way it is possible for an attendant to simply withdraw the tube T, for servicing and cleaning.

A set of manual controls, typically being pressure sensitive button switches indicated generally as 72, are mounted on the front of the door, and are connected to the control panel 48. The buttons may be programmed in various ways. Typically two of the three buttons will be programmed so as to operate the motor 38 to two different predetermined counts of revolutions of the motor shaft. This will typically correspond to a single serving of liquid, e.g., cream and a double serving of liquid, e.g., cream in the case where the dispenser is used as a cream dispenser.

The third button may be used for continuous run. This might be used in the case where the dispenser is used for dispensing milk or some other form of beverage.

The electronic circuitry whereby these functions are achieved is well known to persons skilled in the art and requires no description.

A temperature sensor 74 having a probe portion 76 is mounted on the rear wall 18. Sensor 74 is connected to the control panel 48.

In order to provide for convenient handling of the flexible bag B, a generally-rectangular open-topped bag receptacle 78 is provided, which may be dimensioned so as to simply slide in and out on the support wall 22. The receptacle 78 will be provided at its forward end, in its bottom wall with an opening 80, to receive the tube T. In many cases, the bag B and tube T will be provided with a rigid plastic collar indicated as C in FIG. 6. In this case, the hole 80 may advantageously be provided in a keyhole fashion, with a larger portion adapted to receive the collar C, and a smaller portion into which the collar C can be pushed in a locking action, as shown in FIG. 6.

Figure 6:
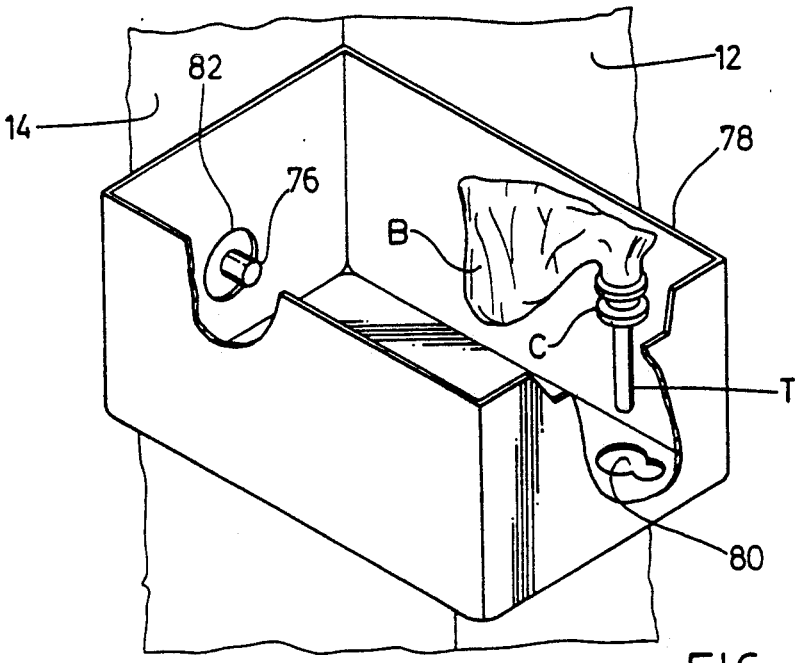
FIG. 6 is a perspective, partially cut-away showing the receptacle for the bag.

The receptacle 78 also has an opening 82 in one of its walls, typically its rear wall as shown in FIG. 6. The opening 82 will register with the probe 76. In this way the probe 76 can enter through the opening 82 and come into contact with the bag B itself. Thus the temperature sensor 74 is at all times sensing the actual temperature of the liquid contents of the bag B.

Figure 7:
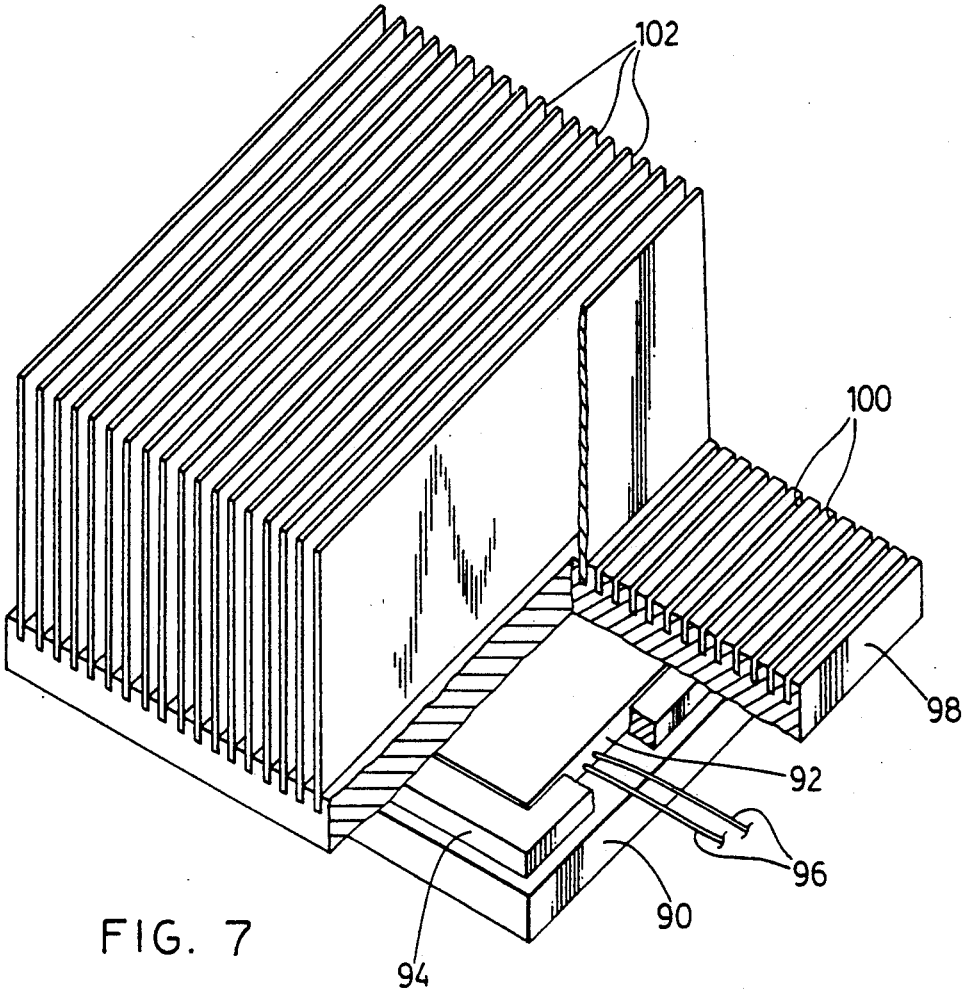
FIG. 7 is a perspective illustration of the heat exchanger.
Figure 8:
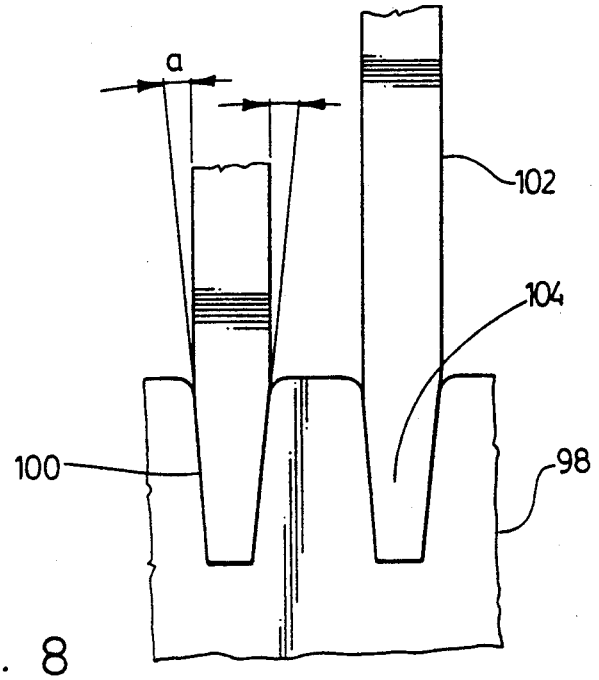
FIG. 8 is a section along the line 8-8 of FIG. 7.

In order to chill the insulated chamber 10, the heat exchanger unit is provided, which is shown in more detail in FIGS. 7 and 8.

It will be seen to comprise a base or mounting body portion 90, which is typically a solid block of metal, which is adapted to be mounted on the top wall 18 of the insulated chamber 10. Top wall 14 is provided with one or more openings 14A and 14B in the insulation, against which the mounting blocks 90 may be set, for maximum heat transfer.

On mounting block 90, there is provided a thermal electric device 92 surrounded by a protective frame 94, and connected by wires 96 to the control panel 48.

A heat exchange block 98 is mounted on the thermal electric device (TED) 92.

Thermal electric devices are well known in the art, and require no separate description. Upon activation by electrical power, they transfer heat, one side becoming hot and the other side becoming cold.

The heat exchange block 98 will thus be mounted on the hot side. Heat exchange block 98 is provided with a large number of spaced parallel grooves 100. As best shown in FIG. 8, the grooves 100 have a cross-section in the form of a taper. Typically the taper will be in the region of 3 to 8 degrees. In the case shown, the angle A of the taper (FIG. 8) is in fact 5 degrees.

A plurality of heat exchange fins 102 are mounted on the block 98. The fins 102 have tapered edges 104. The tapered edges 104 are force-fitted into the tapered grooves 100 in the block 98. The taper angle on the fins matches that of the groove, and thus, by pressure fitting the fins in the grooves a good metal to metal contact is achieved, which produces a highly efficient form of heat transfer.

In this way, it is also possible to provide a very large number of heat exchange plates in a small linear distance across the block 98. In fact, in this way, it is possible to provide in a given length of block 98 as many as double the number of fins, that could be produced if the entire structure were excluded or machined out of a solid block of metal.

It has been found that the operation of the pump 26 may in some circumstances be such as to frictionally engage the tube T and actually draw it through the pump.

Figure 5:
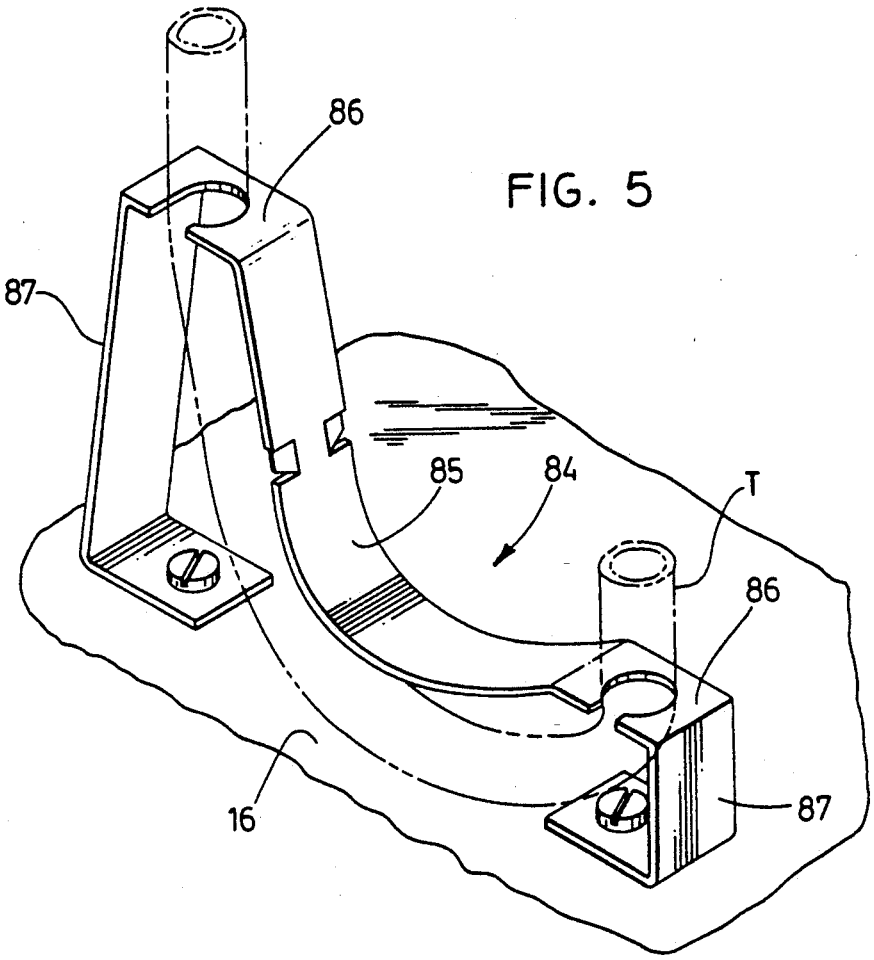
FIG. 5 is a perspective of a holder bracket for the tube.

In order to prevent this, a tube guide 84 is provided on the upper surface of partial bottom wall 16 adjacent to the pump 26. The bracket 84 (FIGS. 1 and 5) comprises a curved guide portion 85, and two end plates 86—86 each having an opening therein to receive the tube. Leg portions 87—87 at each end support the bracket 84 on the bottom wall 16.

The tube T is thus frictionally fitted into the openings in the two plates 86—86, and is then held secure against movement during operation.

The heat exchanger assembly shown in FIG. 7 may be used by itself, or may simply be used as a modular component in an array of such heat exchanger assemblies. Thus in FIG. 2, two such heat exchanger assemblies are shown, each one having the configuration of FIG. 7, and registering with respective uninsulated wall portions 14A and 14B.

In order to provide efficient heat transfer to atmosphere, any form of blower means such as the fan and motor 106 are provided, being connected to the control panel 48. Typically a sheet metal housing 108 will enclose the heat exchangers and fan 106, and will be provided with louvres 110, at front and back to allow flow of air.

In operation an operator first of all chills the bag B in a storage refrigerator (not shown). In fact, such bags B will be normally stored in a storage refrigerator or room, and will only be removed as required, and will never be permitted to rise in temperature.

A bag B is then placed in the receptacle 78, with the tube T passing through the opening 80.

The receptacle is then slid on top of the wall 22. The tube T then hangs downwardly, and is passed through the two openings in the plates 86—86, and is located underneath the curved portion 85.

The tube T is then placed within the housing 44 of the pump, in contact with the roller cams (not shown) and the housing is then closed.

The tube T is then placed in slot 60 of boss 54 and through slots 52. The lower end of the tube T is later cut to provide the dispensing point D.

The thermal electric devices commence chilling the interior of the chamber. The fan commences operating to disperse heat from the heat exchangers. The solenoid 60 is activated so as to close the tube T.

Once the tube T is closed then the lower end can be cut to provide the dispensing point D. Up until this point the tube T has remained sealed to prevent the escape of liquid.

When a person wishes to dispense a portion of the contents of bag B they will simply press one of the three buttons 72. This will then activate motor 38 typically for a predetermined first count or a predetermined second count. Typically the first count will be lower than the second count.

Operation of one of the buttons 72 will also operate the solenoid 65, causing rotation of the boss 54, so that its slot 60 aligns with the slots 52 in the support 50, thereby opening up the tube T and permitting liquid to flow.

As soon as the motor shaft operates, it will then operate the gear shaft at a much slower rate, typically the gear reduction being in the region of between 15 and 20 to 1.

The counter 42 will however count the revolutions of the motor shaft.

Each complete revolution of the pump 26 may dispense only a portion of the beverage required. Consequently if there is a 20 to 1 reduction, and if say four revolutions of the pump are required to dispense a unit portion of beverage, then the motor will be required to turn 80 revolutions.

As soon as 80 revolutions are counted by the counter 42, the counter logic will then trigger the control panel 48 to signal the brake 40 to close. The brake 40 operates virtually instantaneously, and will stop the motor 38 in less than one revolution.

Simultaneously, the solenoid will once again operate to rotate the boss 54 squeezing tube T, and shutting off further liquid flow.

This form of control thus provides a very accurate metering of the fluid by the pump 26.

This thus provides precise control over the quantity of fluid dispensed.

This is of considerable importance for two reasons. The operator of the restaurant will have an exact control over the amount of fluid actually dispensed to customers. The customers themselves will have an exact amount of the fluid dispensed each time. This, in turn, will ensure that the quality and taste of the beverage will be repeatable time after time without variation.

During this time the heat exchangers will continue to withdraw heat from the interior of the insulated chamber. When a predetermined low temperature is sensed by the sensor 74, then the control panel will automatically reduce the electrical power supplied to the thermal electric devices which then operate at a lower level.

In this way a form of thermostatic control is provided, giving a highly efficient control over the temperature within the insulated chamber.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A dispenser for dispensing liquids in predetermined accurately measured dosages and comprising:

a chamber defining a storage compartment for receiving a liquid container;

and said chamber having a partition wall defining a pump and valve compartment;

an insulated door for said chamber giving access to said pump and valve compartment and to said storage compartment;

thermal insulation means in said storage compartment whereby to provide said chamber insulted on all sides;

heat exchanger means connected with said chamber and adapted to transfer heat from within said chamber, said storage adapted to receive said liquid container, said container having a flexible tube connected to a lower portion thereof, for flow of said liquid from said container;

peristaltic pump means in said pump and valve compartment of said chamber and rotatably operable to pump said liquid along said flexible tube;

pump housing means enclosing said pump and having releasable structure to permit introduction of and removal of said tube;

shut-off valve means at an exit point of said chamber and downstream of said pump means, said valve means comprising a housing having first and second openings and a recess between said first and second openings, a boss rotatably received in said recess and having a slot therethrough, said slot being alignable with said first and second openings in one rotative position of said boss and being rotatable from said one rotative position to another rotative position wherein said slot is misaligned with said first and second openings, said flexible tube having an end distal from said container and inserted through said first and second openings and said slot, whereby when said boss is in said one rotative position, fluid flow is permitted through said flexible tube, and when said boss is in said another rotative position fluid flow through said tube is precluded;

power-operated means located exteriorly of said chamber for operating said shut-off valve means;

motor means located exteriorly of said chamber for driving said pump means and having a motor shaft adapted for rotating at the speed of said motor means;

a revolution counter coupled to said motor shaft and connected to a counter logic circuit whereby to count each revolution of said motor means, whereby to obtain a precise count of the revolutions of said motor means, said counter logic circuit being adapted to generate a count signal when a predetermined count of said revolutions of said motor means is reached, and, manual control means mounted on the exterior of said chamber and connected to said shut-off valve and to said motor means, and connected to said counter logic circuit, whereby upon operation of said manual control means, said boss is moved to said one rotative position and said motor shaft is operated for a predetermined count of said counter logic circuit, thereby driving said pump means within said pump and valve compartment a prescribed number of revolutions and said counter logic circuit automatically stopping said motor shaft when said predetermined count is reached and said boss is concurrently moved to said another rotative position whereby, in turn, to maximize the accuracy of the rotation of said pump means and thus the accuracy of the dosage of liquid delivered thereby.

2. A dispenser as claimed in claim 1, wherein said peristaltic pump means has at least two roller cams, and a movable housing for receiving said tube.

3. A dispenser as claimed in claim 1, including a removable receptacle for receiving said liquid container, said receptacle defining a bottom, side walls, an a back wall, and having tube opening means in said bottom wall for passage of said tube therethrough, sensing opening means in one of said side walls and said back wall, and temperature sensing means secured in said chamber, having a probe portion adapted to enter said sensing opening in said receptacle, whereby to continuously sense the actual temperature of the contents of said container.

4. A dispenser as claimed in claim 1, wherein said motor means and said power operated means are located exteriorly of said insulated chamber, and wherein a gear shaft operatively coupled to said motor shaft passes through said partition wall of said chamber for operation of said pump means within said pump and valve compartment of said chamber, and wherein said power-operated means is operatively connected through said partition wall of said chamber to said shut-off valve, within said pump and valve compartment.

5. A dispenser as claimed in claim 1 and wherein said heat exchanger means includes:

a thermal electric device responsive to electrical power to cause a temperature differential thereacross;

a heat exchanger plate portion mounted on the hot side of said thermal electric device;

a plurality of parallel grooves formed in said plate portion, each groove having a tapered cross-section;

a plurality of heat exchanger fins;

an edge portion on each said fin formed with a cross-sectional configuration in the form of a taper matching the taper of said grooves, and wherein the angle of said taper is designed to procure frictional retention of said tapered edges of said fins in said grooves;

opening means formed in said insulative means said heat exchanger plate portion being secured to a wall in said opening means whereby to transfer heat from said chamber through said wall.

6. A dispenser as claimed in claim 1, wherein said power-operated means comprises:

a solenoid having a reciprocable rod;

a crank arm attached to said rod and translating reciprocations of said rod into rotations of said crank arm;

a stem attached generally perpendicularly to said crank arm at one end thereof and to said boss at another end thereof;

whereby reciprocation of said reciprocable rod results in rotative movement of said boss.

* * * * *